US009774118B2

(12) United States Patent
Imaizumi et al.

(10) Patent No.: US 9,774,118 B2
(45) Date of Patent: Sep. 26, 2017

(54) SUBSTRATE TERMINAL AND SUBSTRATE WITH TERMINAL

(71) Applicant: YAZAKI CORPORATION, Tokyo (JP)

(72) Inventors: Yoshihito Imaizumi, Shizuoka (JP); Shinya Ozaki, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/945,864

(22) Filed: Nov. 19, 2015

(65) Prior Publication Data

US 2016/0149325 A1 May 26, 2016

(30) Foreign Application Priority Data

Nov. 21, 2014 (JP) ..... 2014-236765

(51) Int. Cl.
*H01R 12/71* (2011.01)
*H01R 12/58* (2011.01)

(52) U.S. Cl.
CPC ..... *H01R 12/716* (2013.01); *H01R 12/58* (2013.01)

(58) Field of Classification Search
CPC ..... H01R 12/716; H01R 12/58
USPC ..... 439/83, 82, 758
See application file for complete search history.

(56) References Cited

U.S. PATENT DOCUMENTS 3,718,895 A 2/1973 Reynolds et al.
6,431,889 B1 * 8/2002 Olson ..... H01R 13/40 439/157
7,118,392 B2 * 10/2006 Huang ..... H05K 7/1069 439/83
7,357,651 B2 * 4/2008 Minoura ..... H01R 13/111 439/82
7,972,144 B2 * 7/2011 Chang ..... H01R 4/02 439/66

(Continued)

FOREIGN PATENT DOCUMENTS

JP 54-36297 B2 11/1979
JP 10-189179 A 7/1998

(Continued)

OTHER PUBLICATIONS

Communication dated Nov. 8, 2016 from the Japanese Patent Office in counterpart Application No. 2014-236765.

(Continued)

*Primary Examiner* — Alexander Gilman
(74) *Attorney, Agent, or Firm* — Sughrue Mion, PLLC

(57) ABSTRACT

A substrate terminal includes at least one substrate abutting portion configured to be made to abut against a substrate, at least one substrate connection portion configured to be inserted into a hole portion in the substrate and be soldered together with the hole portion with the substrate abutting portion and the substrate abutting against each other, a terminal connection portion to which an opposite-side terminal is inserted in a direction same as an insertion direction of the substrate connection portion into the hole portion and connected, and an intermediate portion configured to connect the substrate abutting portion and the substrate connection portion with the terminal connection portion. A slit is provided between the substrate abutting portion and the substrate connection portion adjacent to each other.

3 Claims, 10 Drawing Sheets

(56) References Cited

U.S. PATENT DOCUMENTS

| | | | | |
|---|---|---|---|---|
| 8,167,629 | B2 * | 5/2012 | Ito | H01R 12/70 439/736 |
| 2001/0041467 | A1 * | 11/2001 | Kikuchi | H01R 12/585 439/82 |
| 2002/0124994 | A1 | 9/2002 | Tanaka et al. | |
| 2011/0189870 | A1 | 8/2011 | Ito et al. | |

FOREIGN PATENT DOCUMENTS

| | | | |
|---|---|---|---|
| JP | 2001-319716 | A | 11/2001 |
| JP | 2002-270263 | A | 9/2002 |
| JP | 2002-270982 | A | 9/2002 |
| JP | 2002-271077 | A | 9/2002 |
| JP | 3432378 | B2 | 8/2003 |
| JP | 2003-272737 | A | 9/2003 |
| JP | 2006-66122 | A | 3/2006 |
| JP | 2007-95629 | A | 4/2007 |
| JP | 2010-15722 | A | 1/2010 |
| JP | 2014-67672 | A | 4/2014 |

OTHER PUBLICATIONS

Communication dated Jul. 5, 2017, issued by the State Intellectual Property Office of People's Republic of China in counterpart application No. 201510813016.9.

* cited by examiner

SUBSTRATE TERMINAL AND SUBSTRATE WITH TERMINAL

CROSS-REFERENCE TO RELATED APPLICATION(S)

The present application claims priority to and incorporates by reference the entire contents of Japanese Patent Application No. 2014-236765 filed in Japan on Nov. 21, 2014.

BACKGROUND OF THE INVENTION

1. Field of the Invention

The present invention relates to a substrate terminal and a substrate with the terminal.

2. Description of the Related Art

Conventionally, a substrate terminal that is soldered to an electronic circuit substrate (hereinafter, referred to as a "substrate") and a substrate with the terminal to which the substrate terminal is attached have been known. The substrate terminal has one or a plurality of substrate connection portion(s). The substrate connection portion is inserted into a corresponding hole portion on the substrate and is soldered together with a land on a peripheral edge of the hole portion (through-hole). In this manner, the substrate terminal is fixed to the substrate. For example, Japanese Patent Application Laid-open No. 2006-66122, Japanese Patent Application Laid-open No. 2007-95629, Japanese Patent Application Laid-open No. 2003-272737, and Japanese Patent Application Laid-open No. 2002-270263 disclose substrate terminals and substrates with the terminals of these types. Japanese Patent Application Laid-open No. 2001-319716 discloses a substrate terminal that is freely detachable from a substrate and the configuration of a substrate connection portion that does not need soldering.

When an opposite-side terminal is connected to the substrate terminal, pressing force from the opposite-side terminal acts on the substrate terminal with an insertion operation of the opposite-side terminal into the substrate terminal. Depending on usage modes, the opposite-side terminal is detached from the substrate terminal in some cases. When the opposite-side terminal is detached, tensile force in the detachment direction acts on the substrate terminal from the opposite-side terminal. For example, in the substrate terminals as disclosed in Japanese Patent Application Laid-open No. 2006-66122 and Japanese Patent Application Laid-open No. 2007-95629, a solder portion between the substrate connection portion and the hole portion in the substrate receives the pressing force and the tensile force. In the substrate terminal as disclosed in Japanese Patent Application Laid-open No. 2003-272737, a resin housing to which the substrate terminal is fixed once receives the pressing force and the tensile force from the opposite-side terminal but there is a possibility that the resin housing is not strong enough to support the pressing force and the tensile force and a solder portion receives them. Thus, the conventional substrate terminals have a risk that an electric connection state between the substrate terminal and a wiring of the substrate is deteriorated because load on the solder portion of the substrate terminal is large in attachment and detachment between the terminals. The substrate terminal as disclosed in Japanese Patent Application Laid-open No. 2002-270263 is molded into a crank form and an intermediate portion opposing the surface of the substrate is provided between the substrate connection portion and a terminal connection portion with the opposite-side terminal. In the substrate terminal, the intermediate portion is held between two plates made of resin. The substrate terminal reduces load on a solder portion in attachment and detachment between the terminals with the configuration in which one plate receives the pressing force when the opposite-side terminal is inserted and the other plate receives the tensile force when the opposite-side terminal is detached. The substrate terminal, however, needs the plates separately. This possibly results in increase of the substrate with the terminal in size and weight and increase in cost with increase in the number of parts.

SUMMARY OF THE INVENTION

It is an object of the present invention to provide a substrate terminal and a substrate with the terminal that can reduce load on a solder portion with a simple configuration.

In order to achieve the above mentioned object, a substrate terminal according to one aspect of the present invention includes at least one substrate abutting portion configured to be made to abut against a substrate; at least one substrate connection portion configured to be inserted into a hole portion in the substrate, and be soldered together with the hole portion with the substrate abutting portion and the substrate abutting against each other; a terminal connection portion to which an opposite-side terminal is inserted in a direction same as an insertion direction of the substrate connection portion into the hole portion and configured to be connected to the opposite-side terminal; and an intermediate portion configured to connect the substrate abutting portion and the substrate connection portion with the terminal connection portion, wherein a slit is provided between the substrate abutting portion and the substrate connection portion adjacent to each other.

Further, in the substrate terminal, it is desirable that the substrate abutting portion, the substrate connection portion, the terminal connection portion, and the intermediate portion are disposed on the same plane.

Further, in the substrate terminal, it is desirable that the slit is disposed so as to overlap with the hole portion when seen in the insertion direction.

Further, in the substrate terminal, it is desirable that one substrate connection portion is disposed and two substrate abutting portions are disposed with the substrate connection portion interposed between the substrate abutting portions.

Further, it is desirable that the substrate terminal further includes an abutting portion configured to abut against a terminal accommodation chamber that is attached to the substrate and accommodates the terminal connection portion, and be provided between the terminal accommodation chamber and the substrate, wherein the abutting portion is configured to be made to abut against an end portion of the terminal accommodation chamber in the insertion direction or a projecting portion projecting toward the substrate from the end portion with the substrate abutting portion and the substrate abutting against each other.

In order to achieve the above mentioned object, a substrate with a terminal according to another aspect of the present invention includes a substrate; and at least one substrate terminal including at least one substrate abutting portion configured to be made to abut against the substrate, at least one substrate connection portion configured to be inserted into a hole portion in the substrate and be soldered together with the hole portion with the substrate abutting portion and the substrate abutting against each other, a terminal connection portion to which an opposite-side terminal is inserted in a direction same as an insertion direction of the substrate connection portion into the hole portion and connected, and an intermediate portion configured to connect the substrate abutting portion and the substrate connection portion with the terminal connection portion, wherein the substrate terminal includes a slit that is provided between the substrate abutting portion and the substrate connection portion adjacent to each other.

Further, in the substrate with the terminal, it is desirable that the substrate abutting portion, the substrate connection portion, the terminal connection portion, and the intermediate portion in the substrate terminal are disposed on the same plane.

Further, in the substrate with the terminal, it is desirable that the substrate is configured to have a land extending to an abutment part between the substrate and the substrate abutting portion from a peripheral edge of the hole portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a substrate terminal and a substrate with the terminal in the invention will be described in detail with reference to the drawings. It should be noted that the embodiments do not limit the invention.

Embodiments

One embodiment of the substrate terminal and the substrate with the terminal in the invention will be described with reference to FIG. 1 to FIG. 4.

Figure 1:
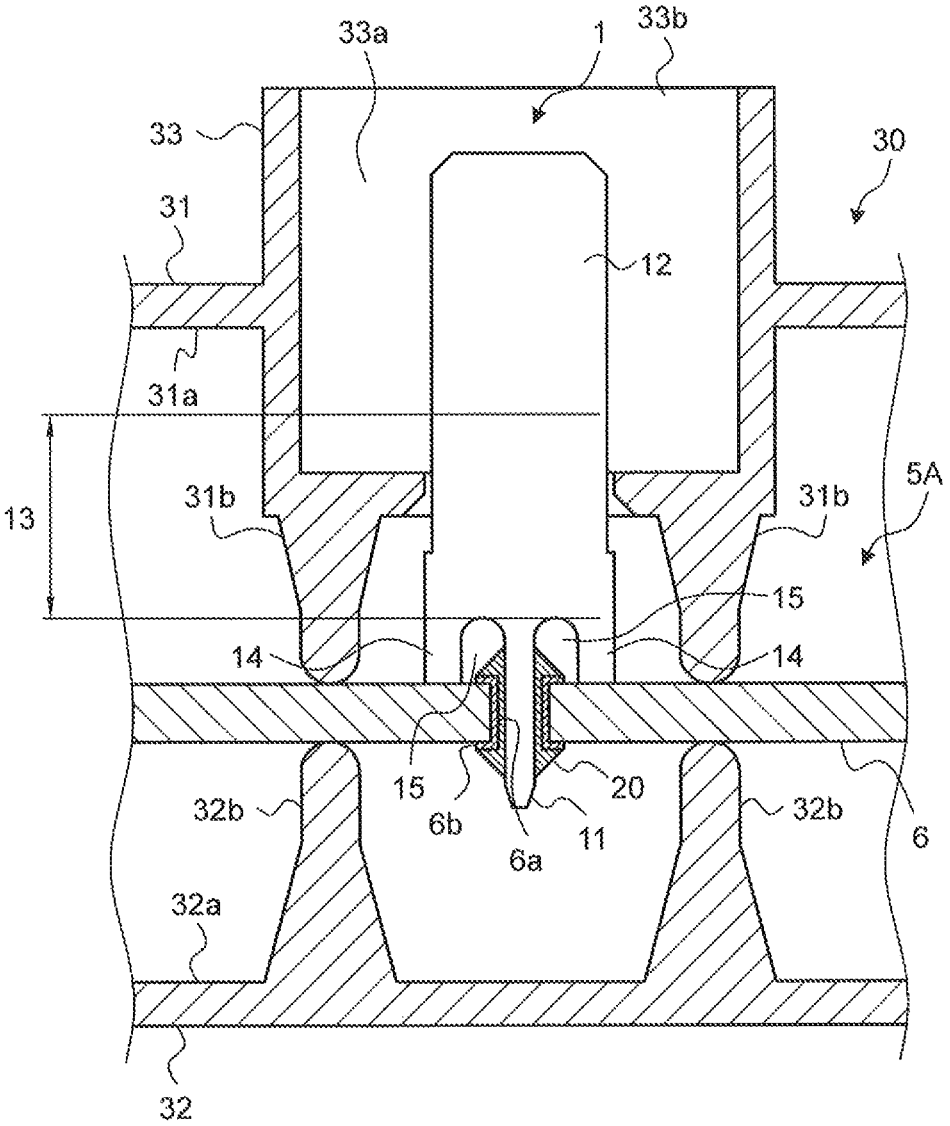
FIG. 1 is a partial sectional view illustrating a substrate terminal and a substrate with the terminal according to embodiments.
Figure 2:
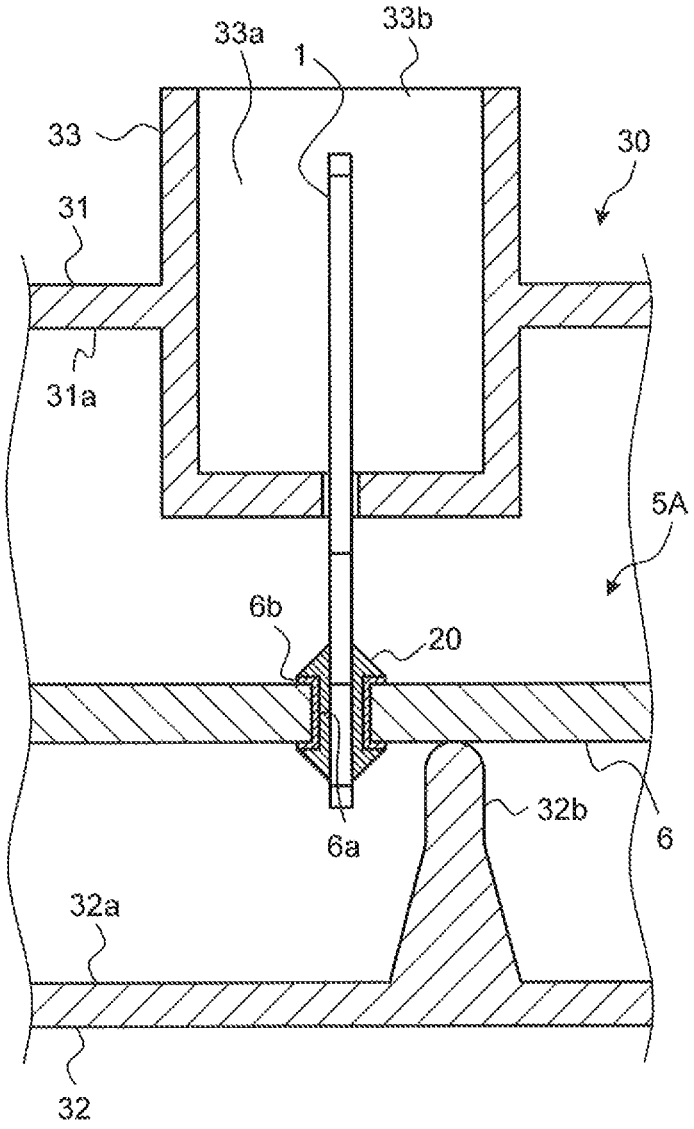
FIG. 2 is a partial sectional view illustrating the substrate terminal and the substrate with the terminal in the embodiments.

A reference numeral 1 in FIG. 1 and FIG. 2 indicates the substrate terminal in the embodiment. A reference numeral 5A indicates the substrate with the terminal in the embodiment. The substrate with the terminal 5A is configured by attaching at least one substrate terminal 1 to a substrate 6 by soldering. The substrate with the terminal 5A is used for a junction box, for example. The substrate 6 in this example is what is called a printed board. FIG. 1 and FIG. 2 are partial sectional views illustrating other parts excluding the substrate terminal 1 by sections.

The substrate terminal 1 is soldered to the substrate 6 so as to establish electric connection with a wiring of the substrate 6. The substrate terminal 1 establishes electric connection with an opposite-side terminal (not illustrated) when the opposite-side terminal is connected to the substrate terminal 1. The opposite-side terminal is provided alone or as a connector on an electronic part (not illustrated) such as a relay and a fuse, an electric wire or a wiring harness (not illustrated), or an electronic apparatus (not illustrated) such as an electronic control apparatus, for example.

The substrate terminal 1 is a terminal fitting formed by molding a conductive metal material into a predetermined male shape or female shape. The substrate terminal 1 may be a male terminal or a female terminal. The substrate terminal 1 may be a terminal molded into a plate-like form (what-is-called tab-like form) or a bar-like form. In the embodiment, the male and plate-like substrate terminal 1 is described as an example. For example, the substrate terminal 1 in this example is press-molded into the following shape.

The substrate terminal 1 includes at least one substrate connection portion 11 that is inserted into a hole portion (through-hole) 6*a* in the substrate 6 from one surface side of the substrate 6 and is soldered together with the hole portion 6*a*. A land 6*b* that is electrically coupled to the wiring of the substrate 6 is formed on the peripheral edge of the hole portion 6*a*. The substrate connection portion 11 is therefore soldered together with the hole portion 6*a* and the land 6*b*. The land 6*b* in this example has a cylindrical portion, in the hole portion 6*a*, connecting two surfaces of the substrate 6. In this case, the substrate connection portion 11 is inserted into an inner part of the cylindrical portion of the land 6*b*. Accordingly, in this example, the inner part of the cylindrical portion of the land 6*b* is referred to as the hole portion 6*a*. In the substrate terminal 1, the orthogonal direction relative to the surfaces of the substrate 6 corresponds to the insertion direction of the substrate connection portion 11 into the hole portion 6*a*. The substrate connection portion 11 is made so that the lengthwise direction thereof extends along the insertion direction. The substrate connection portion 11 in this example has a rectangular main body part extending in the insertion direction and a front end part projecting from the main body part in a lance tip-like form. The substrate connection portion 11 is inserted into the hole portion 6*a* from the front end part and is soldered to the hole portion 6*a* on the main body part thereof.

As described above, the substrate terminal 1 is molded into the plate-like form. In this example, the substrate connection portion 11 is also molded into a plate-like form. The hole portion 6*a* is formed to have a circular shape such that the plate-like substrate connection portion 11 is inserted thereinto. When the substrate connection portion 11 in this example is attached to the substrate 6, the substrate connection portion 11 is pressed into the hole portion 6*a* so as to be made into a self-supporting state on the substrate 6 before being soldered. Accordingly, the substrate connection portion 11 and the hole portion 6*a* are formed to have such sizes that the substrate connection portion 11 can be pressed into the hole portion 6*a*.

Furthermore, the substrate terminal 1 has a terminal connection portion 12 that is connected to an opposite-side terminal as a female terminal. The opposite-side terminal is inserted to the terminal connection portion 12 in the same direction as the insertion direction of the substrate connection portion 11 into the hole portion 6*a*. The terminal connection portion 12 is therefore molded into a rectangular shape so that the lengthwise direction thereof extends along the insertion direction.

The substrate connection portion 11 and the terminal connection portion 12 are connected to each other with a plate-like intermediate portion 13 interposed therebetween. In the substrate terminal 1, the intermediate portion 13 is a portion connecting the substrate connection portion 11 and the following substrate abutting portions 14 with the terminal connection portion 12.

In addition, the substrate terminal 1 includes at least one substrate abutting portion 14 that is made to abut against the substrate 6. The substrate abutting portions 14 are projecting portions extending from the intermediate portion 13 toward the substrate 6. In this example, the substrate abutting portions 14 are made to extend in the above-mentioned insertion direction. The substrate abutting portions 14 are molded into rectangular shapes so that the lengthwise direction thereof extend along the insertion direction.

In the substrate terminal 1, the substrate connection portion 11 is soldered to the hole portion 6*a* with the substrate abutting portions 14 and the substrate 6 abutting against each other. The length of the substrate abutting portions 14 in the above-mentioned insertion direction is therefore smaller than the length of the substrate connection portion 11 in the insertion direction.

In the substrate terminal 1, the terminal connection portion 12, the intermediate portion 13, and the substrate abutting portions 14 are disposed on the same plane. When the opposite-side terminal is inserted to the terminal connection portion 12, pressing force acting on the terminal connection portion 12 associated with the insertion is transmitted to the substrate abutting portions 14 through the intermediate portion 13. With the transmission, abutment parts between the substrate abutting portions 14 and the substrate 6 can receive the pressing force. The pressing force is received by the abutment parts and a solder portion 20 formed between the substrate connection portion 11 and the hole portion 6*a* in a dispersed manner. Accordingly, the substrate terminal 1 can reduce load on the solder portion 20 when the opposite-side terminal is inserted to the terminal connection portion 12 and can reduce stress concentration on the solder portion 20, thereby keeping the electric connection state between the substrate connection portion 11 and the wiring of the substrate 6.

To be specific, in the substrate terminal 1, the substrate connection portion 11 is also disposed on the above-mentioned same plane. In this example, one substrate connection portion 11 is disposed and two substrate abutting portions 14 are disposed with the substrate connection portion 11 interposed therebetween. That is to say, in the substrate terminal 1 in this example, one substrate connection portion 11 is made to project toward the hole portion 6*a* of the substrate 6 from the intermediate portion 13 and the substrate abutting portions 14 are made to project toward the substrate 6 from the intermediate portion 13 at both sides of the substrate connection portion 11.

Voids 15 are provided between the substrate connection portion 11 and the substrate abutting portions 14 adjacent to each other. The voids 15 are like slits for forming the substrate abutting portions 14 so as to be adjacent to the substrate connection portion 11. For example, the substrate abutting portions 14 can be also formed in a state of being continuous to the substrate connection portion 11 without providing the voids 15 therebetween. In the state where the substrate connection portion 11 and the substrate abutting portions 14 are continuous, stress in the lateral direction (short-side direction of the main body part of the substrate connection portion 11 and direction orthogonal to the above-mentioned insertion direction) is increased. In the embodiment, the voids 15 are provided between the substrate connection portion 11 and the substrate abutting portions 14 adjacent to each other. The provision of the voids 15 cause the main body part of the substrate connection portion 11 to be narrower than the case where the main body part and the substrate abutting portions 14 are continuous, thereby dispersing and moderating the stress in the lateral direction. The voids 15 may, however, lower the strength of the substrate terminal 1. The strength is lowered as the length of the voids 15 in the above-mentioned insertion direction is larger. From this viewpoint, the length of the voids 15 is desirably determined so as to moderate the stress in the lateral direction to a desired magnitude while ensuring target strength in design. Furthermore, in order to reduce the stress concentration, end portions of the voids 15 that are parts connecting the substrate connection portion 11 and the substrate abutting portions 14 are desirably formed into arc-like shapes.

Furthermore, the voids 15 are desirably disposed so as to overlap with the hole portion 6*a* when seen in the above-mentioned insertion direction. In this example, the main body part of the substrate connection portion 11 is molded into a rectangular form along the above-mentioned insertion direction and the substrate connection portion 11 is soldered to the hole portion 6*a* on the main body part. The adjacent substrate abutting portions 14 are disposed to be spaced from the substrate connection portion 11, so that the voids 15 formed between them are formed so as to overlap with the hole portion 6*a* when seen in the above-mentioned insertion direction. To be specific, in this example, the substrate connection portion 11, the hole portion 6*a*, and the voids 15 are formed such that the wall surfaces of the voids 15 at the substrate connection portion 11 sides (in other words, the wall surfaces of the substrate connection portion 11 at the sides of the voids 15) and the inner wall surface of the hole portion 6*a* are present on substantially the same virtual plane along the above-mentioned insertion direction. With this formation manner, the hole portion 6*a* and the voids 15 overlap with each other when seen in the above-mentioned insertion direction. In the substrate terminal 1, the voids 15 are formed so as to cause the front ends (projecting ends) of the substrate abutting portions 14 to abut against the substrate 6 appropriately when the substrate connection portion 11 is inserted (pressed) into the hole portion 6*a*. The substrate terminal 1 therefore enables the pressing force acting on the terminal connection portion 12 from the opposite-side terminal to be received by the abutment parts between the substrate abutting portions 14 and the substrate 6 appropriately when the opposite-side terminal is inserted to the terminal connection portion 12.

At least one substrate terminal 1 molded to have the above-mentioned shape is soldered to the substrate 6 as described above so as to configure the substrate with the terminal 5A together with the substrate 6. In the soldering, the substrate connection portion 11 is pressed into the hole portion 6*a* until the substrate abutting portions 14 abut against the substrate 6. Accordingly, the substrate terminal 1 can be made into a self-supporting state on the substrate 6 with no jig or the like. Furthermore, the substrate terminal 1 can be disposed on the substrate 6 at a position and a height within ranges of tolerance for designed values with no jig or the like. While the substrate terminal 1 is kept to be in the self-supporting state, the main body part of the substrate connection portion 11 is soldered together with the hole portion 6*a* and the land 6*b*.

The substrate with the terminal 5A formed in this manner is accommodated in a housing 30, for example. In the housing 30, the substrate 6 is attached to a constituent member of the housing 30. The housing 30 includes a first cover member 31 and a second cover member 32 as the constituent members thereof, for example. The first cover member 31 covers the substrate with the terminal 5A from one surface side. The second cover member 32 covers the substrate with the terminal 5A from the other surface side. As depending on the sizes of the substrate 6, projecting portions 31*b* and 32*b* are formed on the first cover member 31 and the second cover member 32, respectively. The projecting portions 31*b* and 32*b* are made to project toward the surfaces of the substrate 6 from outer wall surfaces 31*a* and 32*a*, respectively. The projecting portions 31*b* and 32*b* are made to abut against the flat planes of the substrate 6.

The terminal connection portion 12 of the substrate terminal 1 is exposed to the outside of the housing 30. The first cover member 31 includes a terminal accommodation chamber 33 that accommodates the substrate connection portion 11 and the substrate abutting portions 14 together with the substrate 6 and accommodates the terminal connection portion 12 in an exposed state. The terminal accommodation chamber 33 is integrated with the first cover member 31, so as to be attached to the substrate 6. The terminal accommodation chamber 33 includes an accommodation space 33*a* and an insertion port 33*b*. The accommodation space 33*a* accommodates therein the terminal connection portion 12 so as to surround it. An opposite-side terminal is inserted through the insertion port 33*b* when the opposite-side terminal is connected to the terminal connection portion 12. One terminal accommodation chamber 33 may be formed as a chamber for one terminal connection portion 12 or may be a chamber that accommodates a plurality of terminal connection portions 12.

With the above-mentioned shape of the substrate terminal 1, the substrate terminal 1 and the substrate with the terminal 5A can disperse the pressing force acting on the terminal connection portion 12 from the opposite-side terminal to the abutment parts between the substrate abutting portions 14 and the substrate 6 and the solder portion 20 when the opposite-side terminal is inserted to the terminal connection portion 12, thereby reducing the load on the solder portion 20. That is to say, the substrate terminal 1 and the substrate with the terminal 5A can reduce the load on the solder portion 20 with a simple configuration and keep the electric connection state between the substrate connection portion 11 and the wiring of the substrate 6. The substrate terminal 1 included in the substrate with the terminal 5A can improve durability of the substrate with the terminal 5A. Furthermore, the substrate with the terminal 5A can improve its durability by using the substrate terminal 1.

The substrate terminal 1 and the substrate with the terminal 5A can disperse the pressing force in connection with the opposite-side terminal with the shape of the substrate terminal 1, thereby eliminating the necessity of a new part for dispersion. The substrate terminal 1 and the substrate with the terminal 5A can therefore reduce the cost (cost of parts themselves and cost of a mold) for cost that is required for the new part. Furthermore, the substrate terminal 1 does not need bending processing. The cost of the substrate terminal 1 and the substrate with the terminal 5A can be therefore reduced for cost that is required for the bending processing. The substrate terminal 1 is not molded into a crank form unlike the conventional terminal. With this, the substrate terminal 1 and the substrate with the terminal 5A can reduce a material for an amount of an intermediate portion of the crank form when the entire length of the substrate terminal 1 is the same as that of the conventional terminal, thereby reducing the cost also in this point. Moreover, the substrate terminal 1 can be made into the self-supporting state on the substrate 6 before soldering. That is to say, the substrate terminal 1 and the substrate with the terminal 5A can eliminate the necessity of a jig for holding the substrate terminal 1 on the substrate 6 before the soldering, thereby simplifying an attachment process and reducing the cost.

Figure 3:
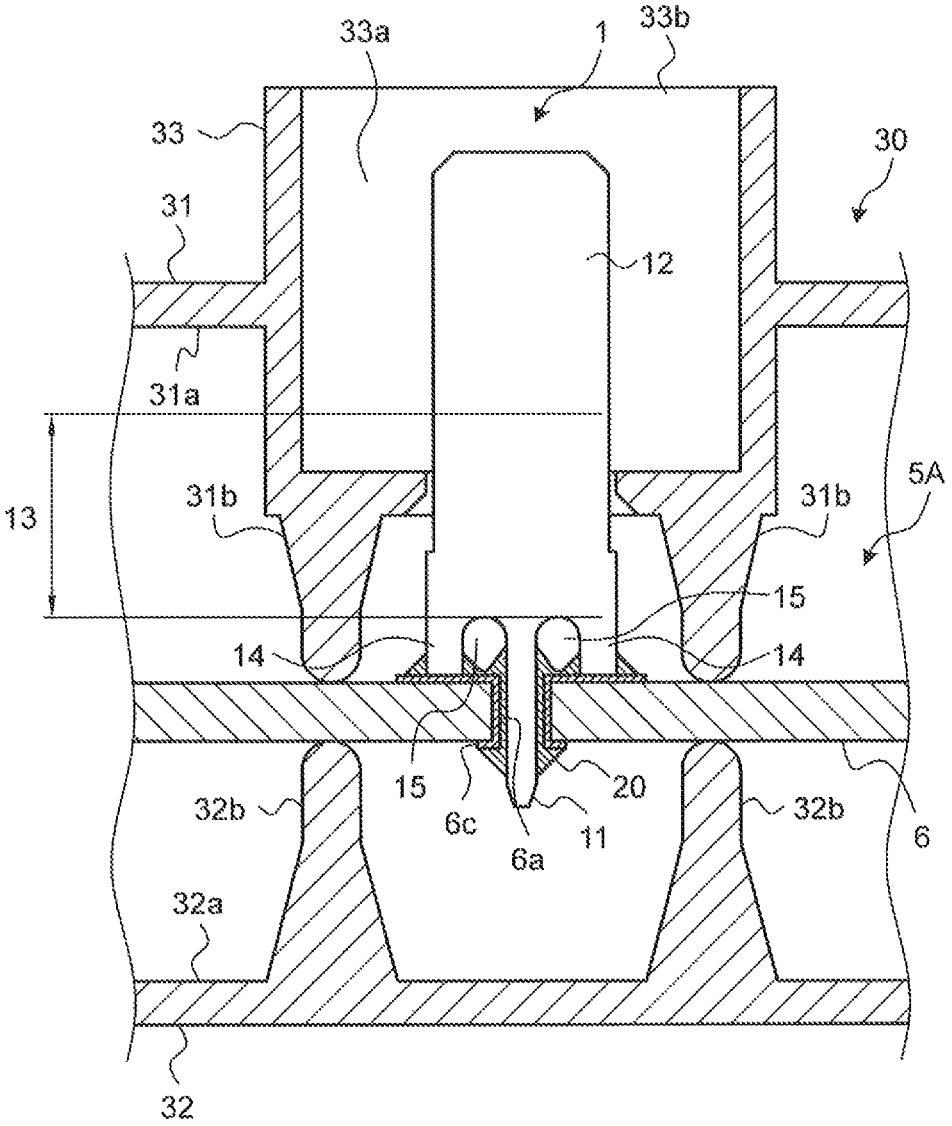
FIG. 3 is a partial sectional view illustrating the configurations of the substrate terminal and the substrate with the terminal in the embodiments in another mode.
Figure 4:
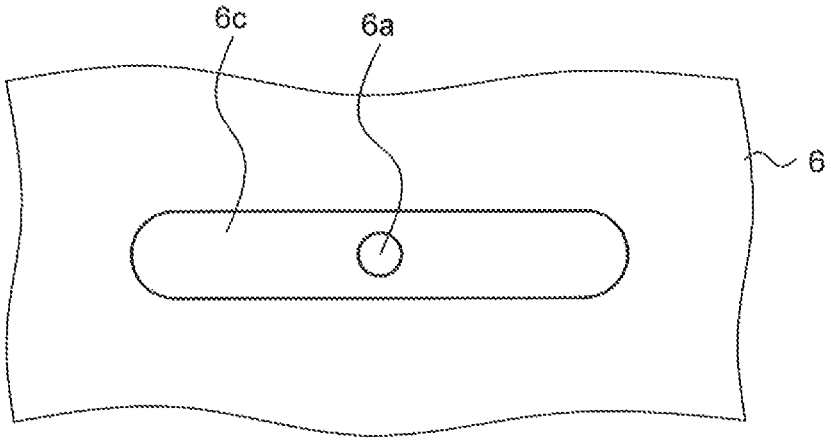
FIG. 4 is a view illustrating a shape of a land in another mode.

The land 6*b* of the substrate 6 may be replaced by what is illustrated (land 6*c*) in FIG. 3 and FIG. 4. The land 6*c* is made to extend to the abutment parts between the substrate 6 and the substrate abutting portions 14 from the peripheral edge of the hole portion 6*a*. In this case, a conductive part between the substrate terminal 1 and the substrate 6 (the land 6*c* and the solder portion 20) can be increased so as to reduce heat generation of the substrate terminal 1. FIG. 3 is a partial sectional view illustrating other parts excluding the substrate terminal 1 by sections.

In this case, solder may be placed between the substrate abutting portions 14 and the land 6*c* so as to also establish electric connection between the substrate abutting portions 14 and the land 6*c*. With this configuration, the pressing force when the opposite-side terminal is connected acts on the solder portion 20 but the pressing force can be received by the solder portion 20 of a larger range than that in the above-mentioned example, thereby reducing the load on the solder portion 20.

Modification

In the above-mentioned embodiment, the configuration in order to reduce the load on the solder portion 20 when the opposite-side terminal is connected has been explained.

The opposite-side terminal is detached from the substrate terminal 1 after connection in some cases when a part is exchanged or maintenance is performed, for example. In this case, in the substrate terminal 1 and the substrate with the terminal 5A in the embodiment, tensile force with the detachment of the opposite-side terminal concentrates on the solder portion 20.

In this modification, a configuration receiving the tensile force is provided.

Figure 5:
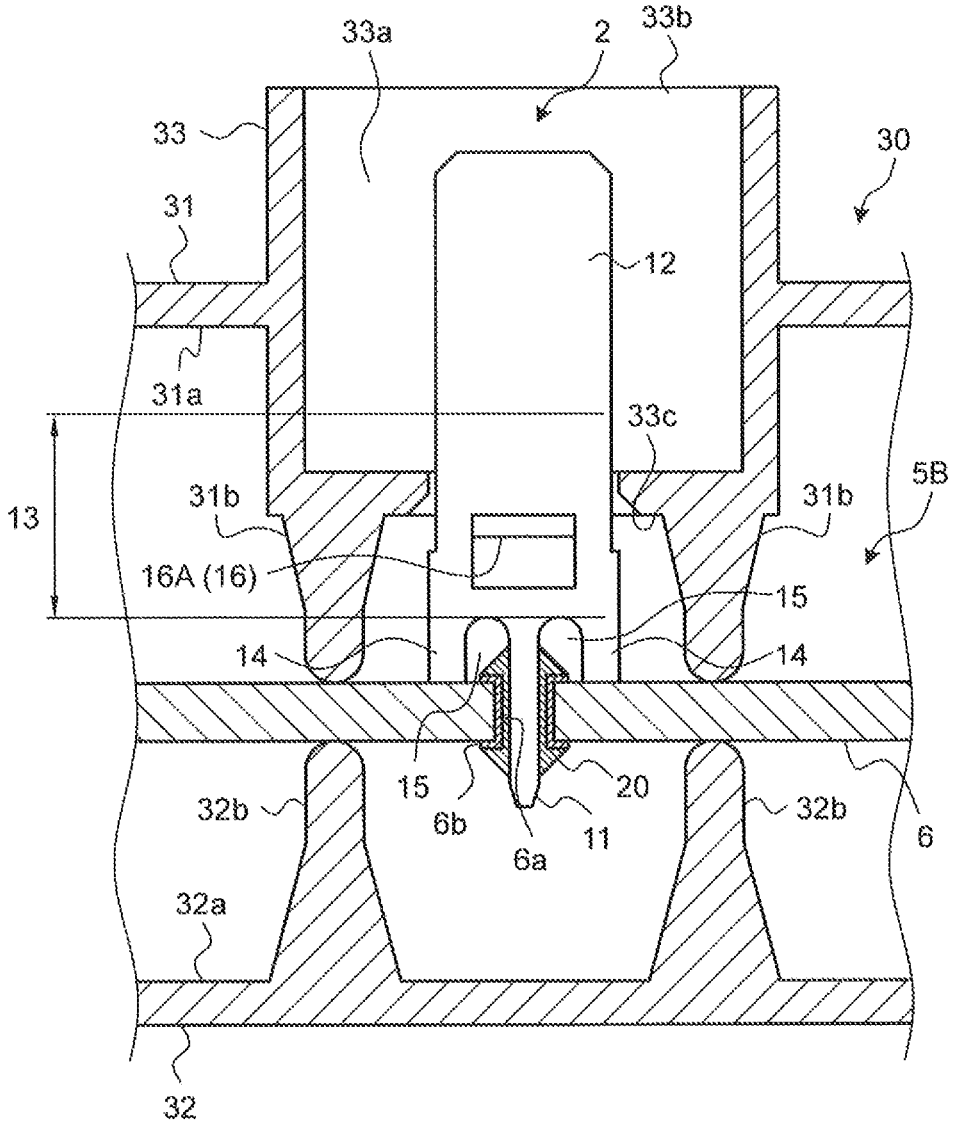
FIG. 5 is a partial sectional view illustrating a substrate terminal and a substrate with the terminal according to a modification.
Figure 6:
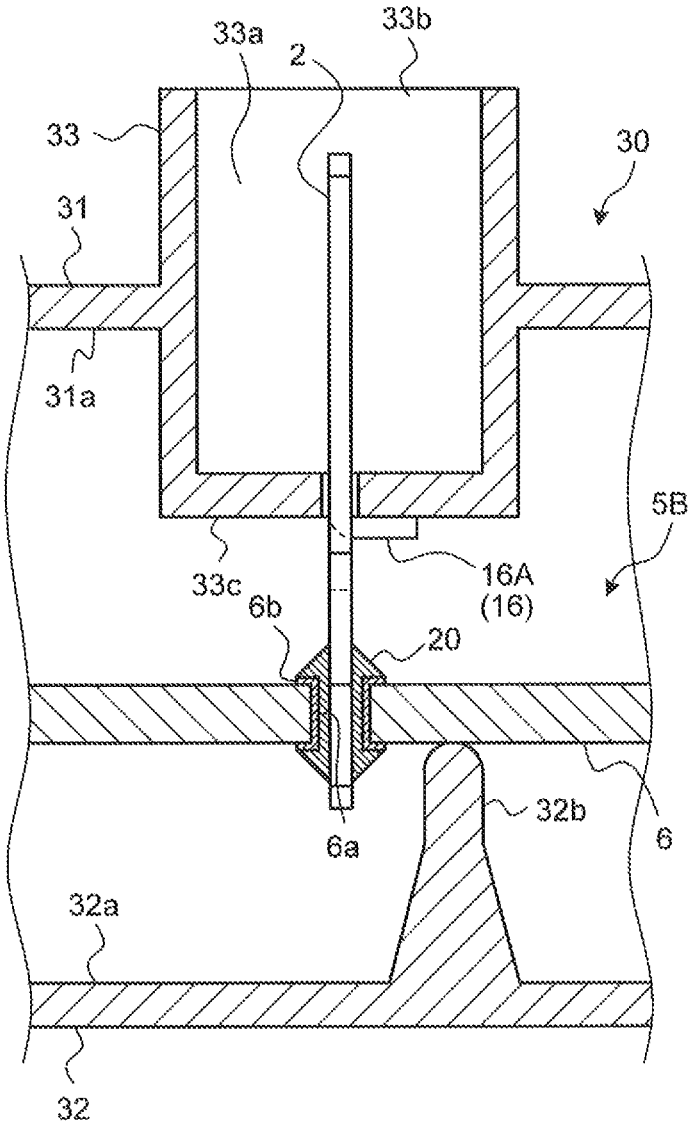
FIG. 6 is a partial sectional view illustrating the substrate terminal and the substrate with the terminal in the modification.

A reference numeral 2 in FIG. 5 and FIG. 6 indicates a substrate terminal in the modification. FIG. 5 and FIG. 6 are partial sectional views illustrating other parts excluding the substrate terminal 2 by sections. A reference numeral 5B indicates a substrate with the terminal in the modification. The substrate with the terminal 5B is configured by attaching at least one substrate terminal 2 to the substrate 6 in the embodiment by soldering.

The substrate terminal 2 in the modification is configured by changing the substrate terminal 1 in the embodiment as follows. The substrate terminal 2 includes the substrate connection portion 11, the terminal connection portion 12, the intermediate portion 13, and the substrate abutting portions 14 equivalent to those in the substrate terminal 1.

The substrate terminal 2 also includes the voids 15 between the substrate connection portion 11 and the substrate abutting portions 14. The substrate terminal 2 in the modification is provided with a site for receiving the tensile force, when the opposite-side terminal is detached, for the terminal equivalent to the substrate terminal 1 in the embodiment. The substrate terminal 2 is provided with, as the site, an abutting portion 16 abutting against the terminal accommodation chamber 33, between the terminal accommodation chamber 33 and the substrate 6.

The abutting portion 16 is made to abut against the terminal accommodation chamber 33 with the substrate abutting portions 14 and the substrate 6 abutting against each other. An abutment site of the terminal accommodation chamber 33 is, for example, an end portion 33*c* of the terminal accommodation chamber 33 in the insertion direction of the opposite-side terminal to the terminal connection portion 12. In other words, the end portion 33*c* is the outer wall portion or the outer wall surface of the terminal accommodation chamber 33 that is present at the opposite side to the accommodation space 33*a* for accommodating the terminal connection portion 12 and the insertion port 33*b* through which the opposite-side terminal is inserted in the attachment and detachment direction of the opposite-side terminal to the terminal connection portion 12.

The substrate terminal 2 can receive the tensile force by the abutting portion 16 and the end portion 33*c* when the opposite-side terminal is detached. The substrate terminal 2 and the substrate with the terminal 5B can reduce load on the solder portion 20 also when the opposite-side terminal is detached. That is to say, the substrate terminal 2 and the substrate with the terminal 5B can further reduce the load on the solder portion 20 with a simple configuration and keep the electric connection state between the substrate connection portion 11 and the wiring of the substrate 6. Accordingly, the substrate terminal 2 included in the substrate with the terminal 5B can improve durability of the substrate with the terminal 5B. Furthermore, the substrate with the terminal 5B can improve its durability by using the substrate terminal 2.

The abutting portion 16 can be formed as a projecting portion projecting from the intermediate portion 13 along the end portion 33*c* in order to abut against the end portion 33*c* of the terminal accommodation chamber 33 with the substrate abutting portions 14 and the substrate 6 abutting against each other, for example.

For example, the abutting portion 16 may be formed by fixing at least another member such as a piece member to the wall surface of the intermediate portion 13.

As illustrated in FIG. 5 and FIG. 6, the abutting portion 16 may be a piece portion 16A that is made to project by making cuts on three sides of a rectangle as the piece portion other than one side while the one side is a bending portion and folding the rectangle from the bending portion by press processing on a center portion of the intermediate portion 13. In this case, the outer shape of the substrate terminal 2 is the same as the outer shape of the substrate terminal 1 in the embodiment other than the abutting portion 16. When a plurality of substrate terminals 2 are installed on the substrate 6, the abutting portion 16 does not require enlargement of a pitch between the substrate terminals 2 in the lateral direction. The substrate terminal 2 can therefore reduce load on the solder portion 20 when the opposite-side terminal is detached and prevent the substrate with the terminal 5B from increasing in size. Furthermore, when the plurality of substrate terminals 2 are collectively punched out from one plate member, the number of terminals same as that of the substrate terminal 1 in the embodiment can be manufactured. In addition, in the substrate terminal 2, hole portion is formed on the intermediate portion 13, thereby moderating the stress on the intermediate portion 13 in the lateral direction.

Figure 7:
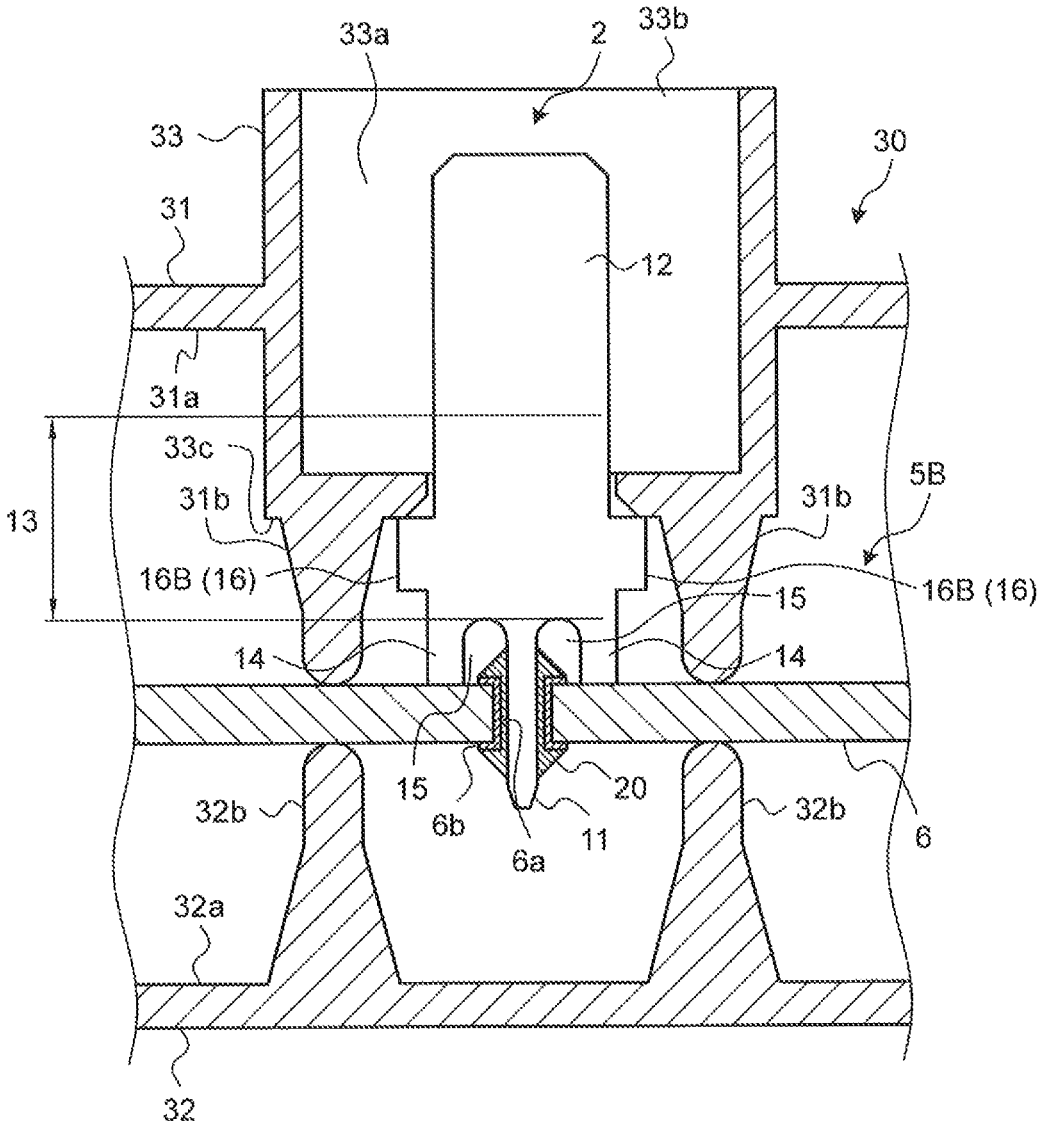
FIG. 7 is a partial sectional view illustrating the configurations of the substrate terminal and the substrate with the terminal in the modification in another mode.
Figure 8:
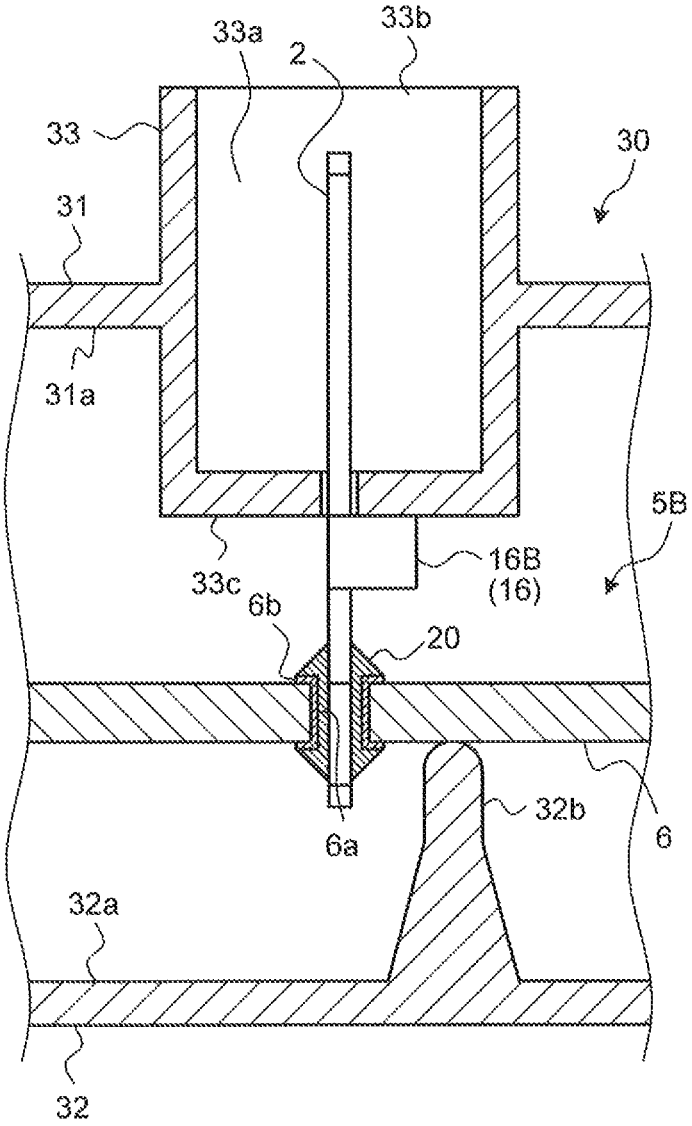
FIG. 8 is a partial sectional view illustrating the configurations of the substrate terminal and the substrate with the terminal in the modification in another mode.

As illustrated in FIG. 7 and FIG. 8, the abutting portion 16 may be a piece portion 16B that is made to project along the end portion 33*c* from at least one of both ends (on a portion that is not continuous to the substrate connection portion 11, the terminal connection portion 12, and the substrate abutting portions 14) of the intermediate portion 13. In this example, the piece portions 16B are provided on both ends of the intermediate portion 13. In this example, the piece portions 16B are bent in the same direction but may be in the opposite directions. FIG. 7 and FIG. 8 are partial sectional views illustrating other parts excluding the substrate terminal 2 by sections.

Figure 9:
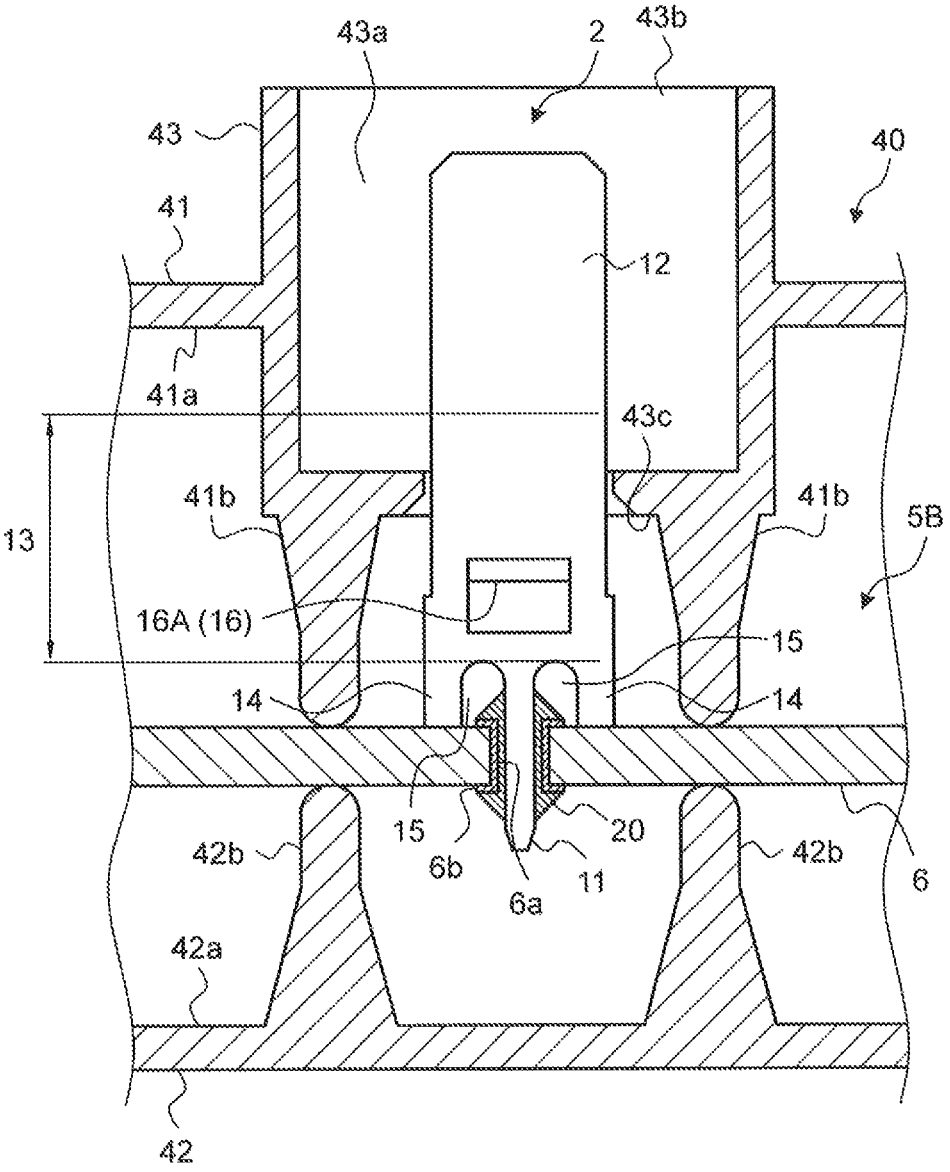
FIG. 9 is a partial sectional view illustrating the configurations of the substrate terminal and the substrate with the terminal in the modification in still another mode.
Figure 10:
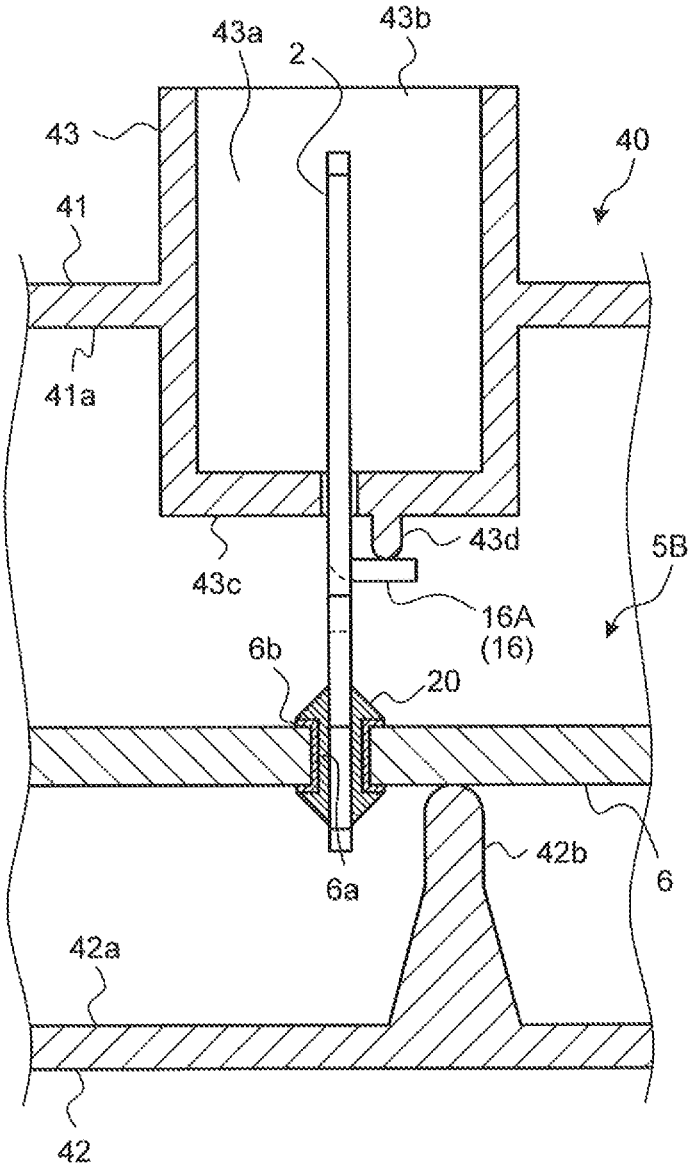
FIG. 10 is a partial sectional view illustrating the configurations of the substrate terminal and the substrate with the terminal in the modification in still another mode.

Depending on various conditions such as the size of the intermediate portion 13 of the substrate terminal 2 and a distance between the terminal accommodation chamber 33 and the substrate 6, the abutting portion 16 cannot be made to abut against the end portion 33*c* of the terminal accommodation chamber 33 in some cases. In this case, for example, the housing 30 is replaced by a housing 40 as illustrated in FIG. 9 and FIG. 10. The housing 40 accommodates therein the substrate with the terminal 5B and includes first and second cover members 41 and 42 equivalent to the first and second cover members 31 and 32 in the embodiment. Projecting portions 41*b* and 42*b* that are made to project toward the surfaces of the substrate 6 from outer wall surfaces 41*a* and 42*a* are formed on the first cover member 41 and the second cover member 42, respectively. Furthermore, the first cover member 41 includes a terminal accommodation chamber 43 equivalent to the terminal accommodation chamber 33 in the embodiment. It should be noted that in the terminal accommodation chamber 43, a projecting portion 43*d* projecting toward the substrate 6 from an end portion 43*c* is provided on the end portion 43*c*. The end portion 43*c* is the outer wall portion or the outer wall surface of the terminal accommodation chamber 43 that is present at the opposite side to an accommodation space 43*a* for accommodating the terminal connection portion 12 and an insertion port 43*b* through which the opposite-side terminal is inserted in the attachment and detachment direction of the opposite-side terminal to and from the terminal connection portion 12 in the same manner as the end portion 33*c* described above. The abutting portion 16 in this case is formed in the same manner as the above-mentioned piece portion 16A(16B) so as to abut against the projecting portion 43*d* of the terminal accommodation chamber 43 with the substrate abutting portions 14 and the substrate 6 abutting against each other. In FIG. 9 and FIG. 10, the piece portion 16A is used as an example. The substrate terminal 2 and the substrate with the terminal 5B even configured as described above can provide the same effects as those when the abutting portion 16 is made to abut against the end portion 33*c* (end portion 43*c*). FIG. 9 and FIG. 10 are partial sectional views illustrating other parts excluding the substrate terminal 2 by sections.

The substrate terminal and the substrate with the terminal according to the invention disperse pressing force acting on the terminal connection portion from the opposite-side terminal to the abutment part of the substrate abutting portion against the substrate and a solder portion (portion on which the substrate connection portion and the hole portion are soldered) when the opposite-side terminal is inserted into the terminal connection portion, thereby reducing load on the solder portion. That is to say, the substrate terminal and the substrate with the terminal can reduce load on the solder portion with a simple configuration by providing the substrate abutting portion that is made to abut against the substrate on the substrate terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A substrate terminal comprising:

at least one substrate abutting portion configured to be made to abut against a substrate;

at least one substrate connection portion configured to be inserted into a hole portion in the substrate, and be soldered together with the hole portion with the substrate abutting portion and the substrate abutting against each other;

a terminal connection portion to which an opposite-side terminal is inserted in a direction same as an insertion direction of the substrate connection portion into the hole portion and configured to be connected to the opposite-side terminal;

an intermediate portion configured to connect the substrate abutting portion and the substrate connection portion with the terminal connection portion; and an abutting portion provided between a terminal accommodation chamber and the substrate and configured to abut against the terminal accommodation chamber that is attached to the substrate and accommodates the terminal connection portion, wherein a slit is provided between the substrate abutting portion and the substrate connection portion adjacent to each other, and wherein the substrate abutting portion, the substrate connection portion, the terminal connection portion, and the intermediate portion are disposed on the same plane, the slit is disposed so as to overlap with the hole portion when seen in the insertion direction, one substrate connection portion is disposed and two substrate abutting portions are disposed with the substrate connection portion interposed between the substrate abutting portions, and the abutting portion is configured to be made to abut against an end portion of the terminal accommodation chamber in the insertion direction or a projecting portion projecting toward the substrate front the end portion with the substrate abutting portion and the substrate abutting against each other.

2. A substrate with a terminal comprising:

a substrate; and at least one substrate terminal including at least one substrate abutting portion configured to be made to abut against the substrate, at least one substrate connection portion configured to be inserted into a hole portion in the substrate and be soldered together with the hole portion with the substrate abutting portion and the substrate abutting against each other, a terminal connection portion to which an opposite-side terminal is inserted in a direction same as an insertion direction of the substrate connection portion into the hole portion and connected, an intermediate portion configured to connect the substrate abutting portion and the substrate connection portion with the terminal connection portion, and an abutting portion provided between a terminal accommodation chamber and the substrate and configured to abut against the terminal accommodation chamber that is attached to the substrate and accommodates the terminal connection portion, wherein the substrate terminal includes a slit that is provided between the substrate abutting portion and the substrate connection portion adjacent to each other, and wherein the substrate abutting portion, the substrate connection portion, the terminal connection portion, and the intermediate portion are disposed on the same plane, the slit is disposed so as to overlap with the hole portion when seen in the insertion direction, one substrate connection portion is disposed and two substrate abutting portions are disposed with the substrate connection portion interposed between the substrate abutting portions, and the abutting portion is configured to be made to abut against an end portion of the terminal accommodation chamber in the insertion direction or a projecting portion projecting toward the substrate from the end portion with the substrate abutting portion and the substrate abutting against each other.

3. The substrate with the terminal according to claim 2, wherein the substrate is configured to have a land extending to an abutment part between the substrate and the substrate abutting portion from a peripheral edge of the hole portion.

* * * * *